US008940111B2

(12) United States Patent
Mašek et al.

(10) Patent No.: US 8,940,111 B2
(45) Date of Patent: Jan. 27, 2015

(54) METHOD OF ACHIEVING TRIP MICROSTRUCTURE IN STEELS BY MEANS OF DEFORMATION HEAT

(71) Applicants: Bohuslav Mašek, Kaznějov (CZ); Hana Jirková, Strakonice (CZ); Andrea Ronešová, Plzeň (CZ); Štěpán Jeníček, Rotava (CZ); Ctibor Štádler, Plzeň (CZ)

(72) Inventors: Bohuslav Mašek, Kaznějov (CZ); Hana Jirková, Strakonice (CZ); Andrea Ronešová, Plzeň (CZ); Štěpán Jeníček, Rotava (CZ); Ctibor Štádler, Plzeň (CZ)

(73) Assignee: Západočeská Univerzita V Plzni (CZ)

( * ) Notice: Subject to any disclaimer, the term of this patent is extended or adjusted under 35 U.S.C. 154(b) by 290 days.

(21) Appl. No.: 13/631,186

(22) Filed: Sep. 28, 2012

(65) Prior Publication Data

US 2013/0081741 A1 Apr. 4, 2013

(30) Foreign Application Priority Data

Sep. 30, 2011 (CZ) ..... 2011-612

(51) Int. Cl.
*C21D 8/00* (2006.01)
*C21D 7/13* (2006.01)

(Continued)

(52) U.S. Cl.
CPC ..... *C21D 7/13* (2013.01); *C21D 8/0205* (2013.01); *C21D 8/0231* (2013.01);

(Continued)

(58) Field of Classification Search
None
See application file for complete search history.

(56) References Cited

U.S. PATENT DOCUMENTS 6,190,469 B1 * 2/2001 Koh et al. ..... 148/500

(Continued)

FOREIGN PATENT DOCUMENTS

CN 102212657 A 10/2011

(Continued)

OTHER PUBLICATIONS

Search Reported dated Jul. 10, 2012 issued in Czech Republic Priority Application No. PV 2011-612 filed Sep. 30, 2011 (4 pages).

*Primary Examiner* — Deborah Yee
(74) *Attorney, Agent, or Firm* — Hovey Williams LLP

(57) ABSTRACT

In a first step of the method of achieving TRIP microstructure in steels by deformation heat, steel feedstock is heated to a temperature below the temperature at which austenite begins to form in the steel in question, i.e. below $A_{C1}$. In a next step, the feedstock is formed into a final product, using applied severe plastic deformation whereby deformation energy causes the temperature of the material to increase to the final temperature between $A_{C1}$ and $A_{C3}$, and whereupon the ferrite-pearlite microstructure transforms into austenite. In a third or last process step, the final product is cooled down from the final temperature to the temperature of the bainite nose of the material (B). The cooling is then interrupted and the material is held at the temperature of the bainite nose (B). Consequently, the TRIP microstructure forms. Finally, the product is cooled down to ambient temperature.

3 Claims, 3 Drawing Sheets

(51) Int. Cl.
*C21D 8/02* (2006.01)
*C21D 9/46* (2006.01)
*C21D 1/20* (2006.01)

(52) U.S. Cl.
CPC ..... *C21D 8/0263* (2013.01); *C21D 9/46* (2013.01); *C21D 1/20* (2013.01); *C21D 2211/002* (2013.01); *C21D 2211/005* (2013.01)
USPC ..... 148/654

(56) References Cited

U.S. PATENT DOCUMENTS 6,328,826 B1 * 12/2001 Iung et al. ..... 148/541
8,114,227 B2 * 2/2012 Corquillet et al. ..... 148/647
2008/0199347 A1 * 8/2008 Barges et al. ..... 420/120
2009/0214377 A1 * 8/2009 Hennig et al. ..... 420/120

FOREIGN PATENT DOCUMENTS

CZ 2997769 B6 7/2011
DE 4323167 C1 5/1994
DE 102005051052 A1 4/2007
JP 57114016 A 7/1982

* cited by examiner

METHOD OF ACHIEVING TRIP MICROSTRUCTURE IN STEELS BY MEANS OF DEFORMATION HEAT

BACKGROUND OF THE INVENTION

1. Field of the Invention

The proposed technical solution falls within the field of altering physical properties of steels by means of forming.

2. Description of the Related Art

TRIP steels are high-strength multiphase steels that contain ferrite, bainite and retained austenite. They have been developed for making sheet parts in automotive industry. However, their large capacity for deformation makes them suitable candidates for other processes as well. Cold forming used for achieving the required shape of the part is one of such processes. During cold deformation, retained austenite transforms into martensite, after which TRIP steels were named: Transformation Induced Plasticity.

These materials are well established in production of steel sheet. There are two basic methods of their processing. The first relies on hot rolling of sheets (represented by the wavy line located above $A_{c3}$ on the isothermal transformation curve of the temperature (T) vs. time (t) chart for steels) in fully austenitic condition followed by cooling down to the bainite nose area (FIG. 1) (in the isothermal transformation curves of FIGS. 1, 2 and 3, the curve F represents the ferrite formation nose, the curve P represents the pearlite formation nose and the curve B represents the barite formation nose). A hold at that temperature causes a certain proportion of metastable austenite to decompose into bainite. The remaining part of retained austenite is preserved. Upon the hold, the retained austenite remains stable enough to survive further cooling to room temperature.

The second method uses hot forming (represented by the wavy line on the isothermal transformation curve located above $A_{C3}$) followed by cold forming (represented by the wavy line on the isothermal transformation curve located below $M_S$) (FIG. 2). The resulting metal sheet is annealed in the intercritical region between $Ac_1$ and $Ac_3$. This leads to incomplete austenitization. The material is then cooled down to and held at the bainite nose temperature in order for bainite to form and for retained austenite to become stable. Both of the above-described methods lead to multi-phase microstructures containing ferrite, bainite and retained austenite.

The drawback of hot forming lies in that the material is heated to the fully austenitic region, i.e. its temperature is relatively high above $Ac_3$. The surface at this temperature oxidizes rapidly. Scales impair the surface quality and cause materials losses. In addition, heating of feedstock to high temperatures requires relatively large amount of energy.

These drawbacks are substantially alleviated by the proposed solution.

SUMMARY OF THE INVENTION

The present invention relates to a method of achieving TRIP microstructure in steels by means of deformation heat.

In a first step of the method, steel feedstock may be heated to a temperature below the austenite region, i.e. below $Ac_1$. Steel feedstock may preferably be made from low-alloyed steel containing Si, Mn or Al.

In a second step, the feedstock may be formed into a final product, using severe plastic deformation. Deformation energy which is introduced into the material during forming with severe plastic deformation raises its temperature to the final temperature ranging between $Ac_1$ and $Ac_3$, i.e. between the lower and upper boundaries of its austenite region. By this means, a portion of the ferrite-pearlite microstructure transforms into austenite. At temperatures above $Ac_1$, the plasticity of the material is sufficient for it to sustain intensive forming. Optionally, severe plastic deformation may be applied in the form of an incremental forming schedule, which consists of several deformation steps.

In a further or last process step, the final product may be cooled down from the final temperature to the temperature of the bainite nose and held. Consequently, it develops the TRIP microstructure. Thereafter, the product may be cooled down to ambient temperature.

The employment of a process, which pushes the forming temperature well below $Ac_1$, will reduce the total energy consumed in soaking the feedstock. In addition, such a process can substantially improve the surface quality and precision of the formed product. Deformation energy drives the formation of TRIP-type microstructure and increases the temperature of the feedstock to the required level without any heat being supplied from outside by conventional means, such as external heating. Moreover, the procedure is substantially shorter in time than conventional processes and allows the subsequent controlled cooling to be linked with the preceding forming process, rather than taking place separately. As a result, an energy-efficient production chain based on thermomechanical treatment can be built, which allows products from TRIP steels to be manufactured.

BRIEF DESCRIPTION OF THE DRAWINGS

An example embodiment of the proposed solution is described with reference to the drawings, which show the following.

EXAMPLE EMBODIMENT

Figure 1:
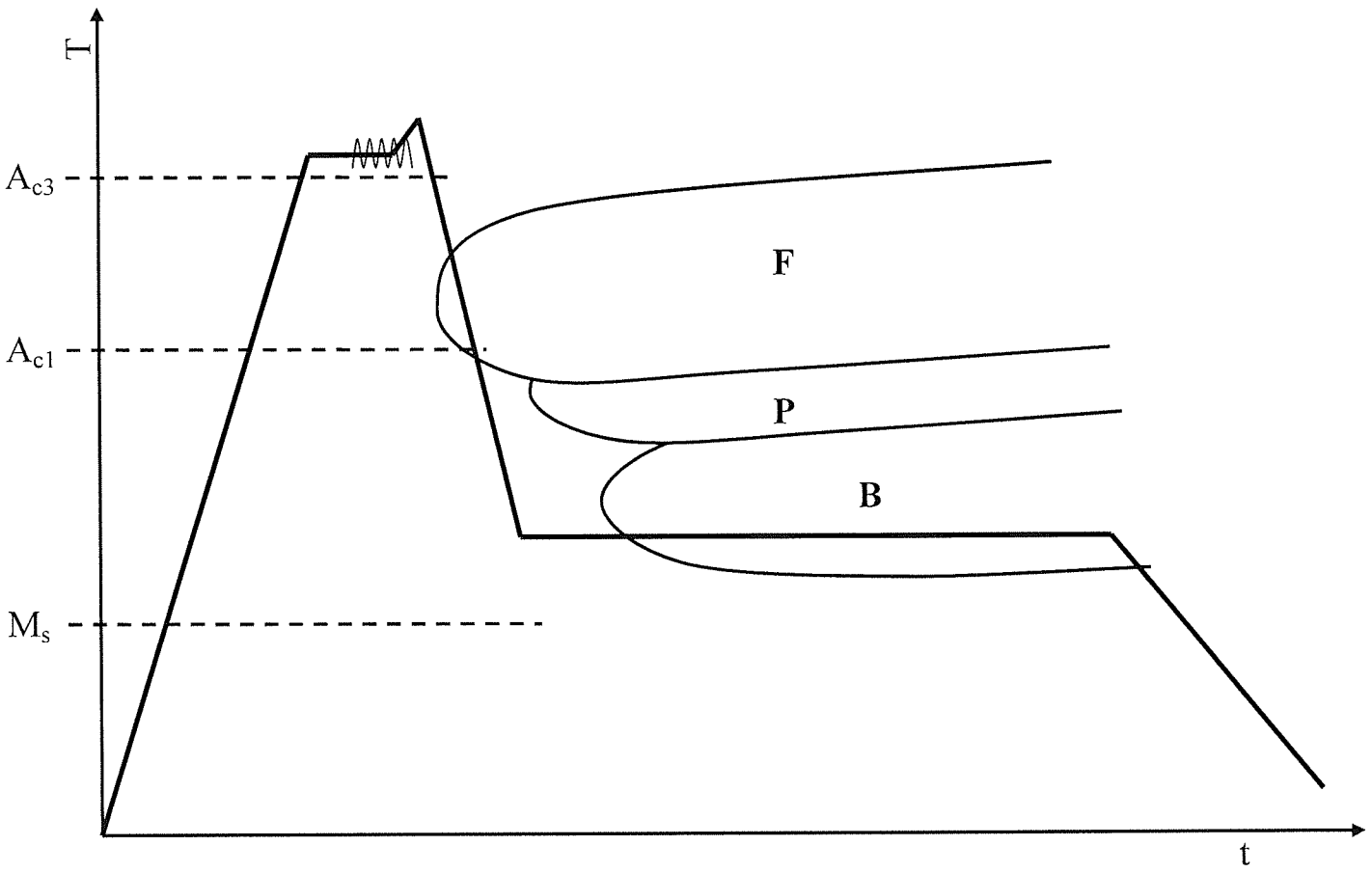
FIG. 1—Prior art: hot forming in fully austenitic region
Figure 2:
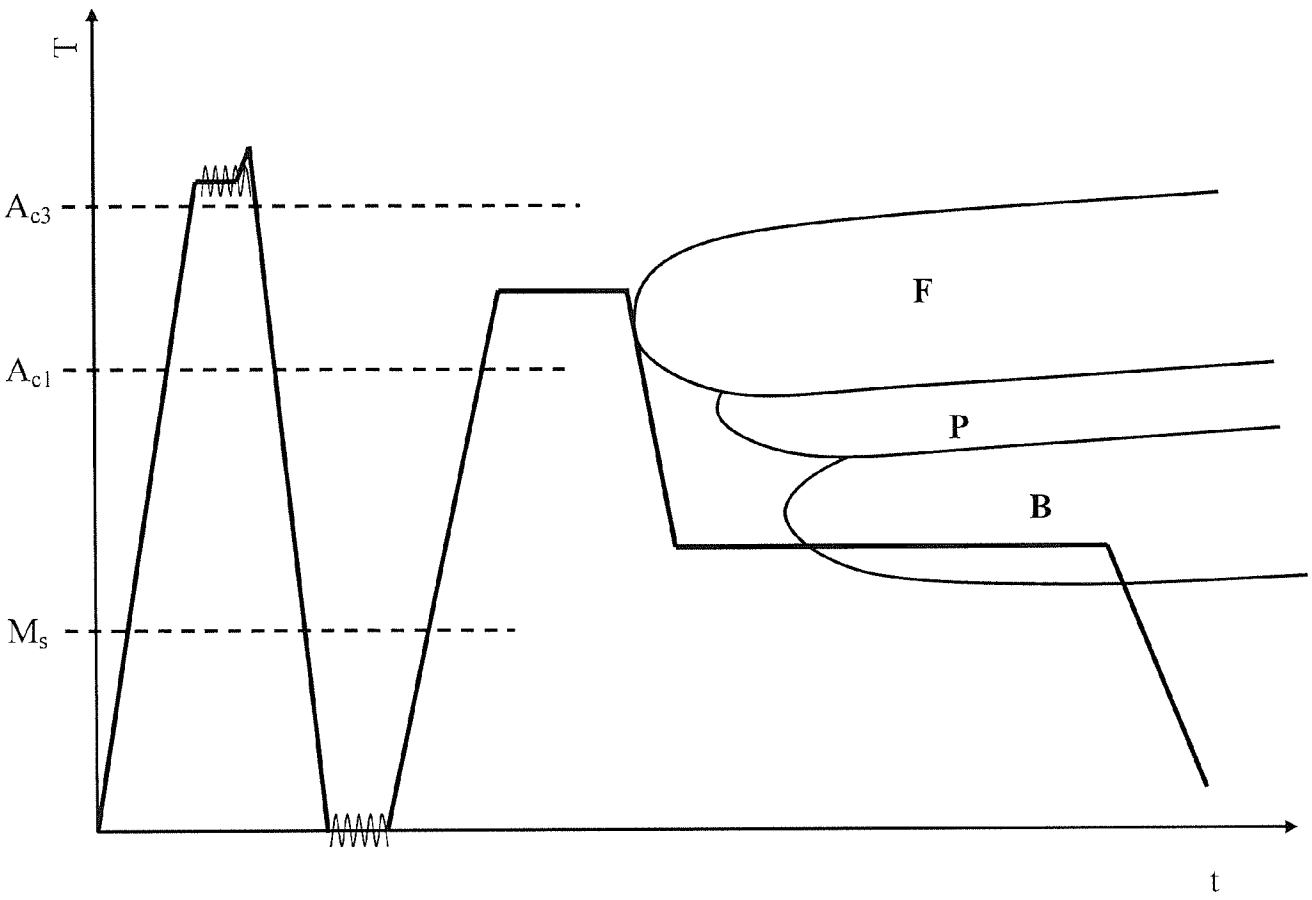
FIG. 2—Prior art: hot forming followed by cold forming, incorporating intercritical annealing FIG. 3—Invention: forming with the use of deformation heat.
Figure 3:
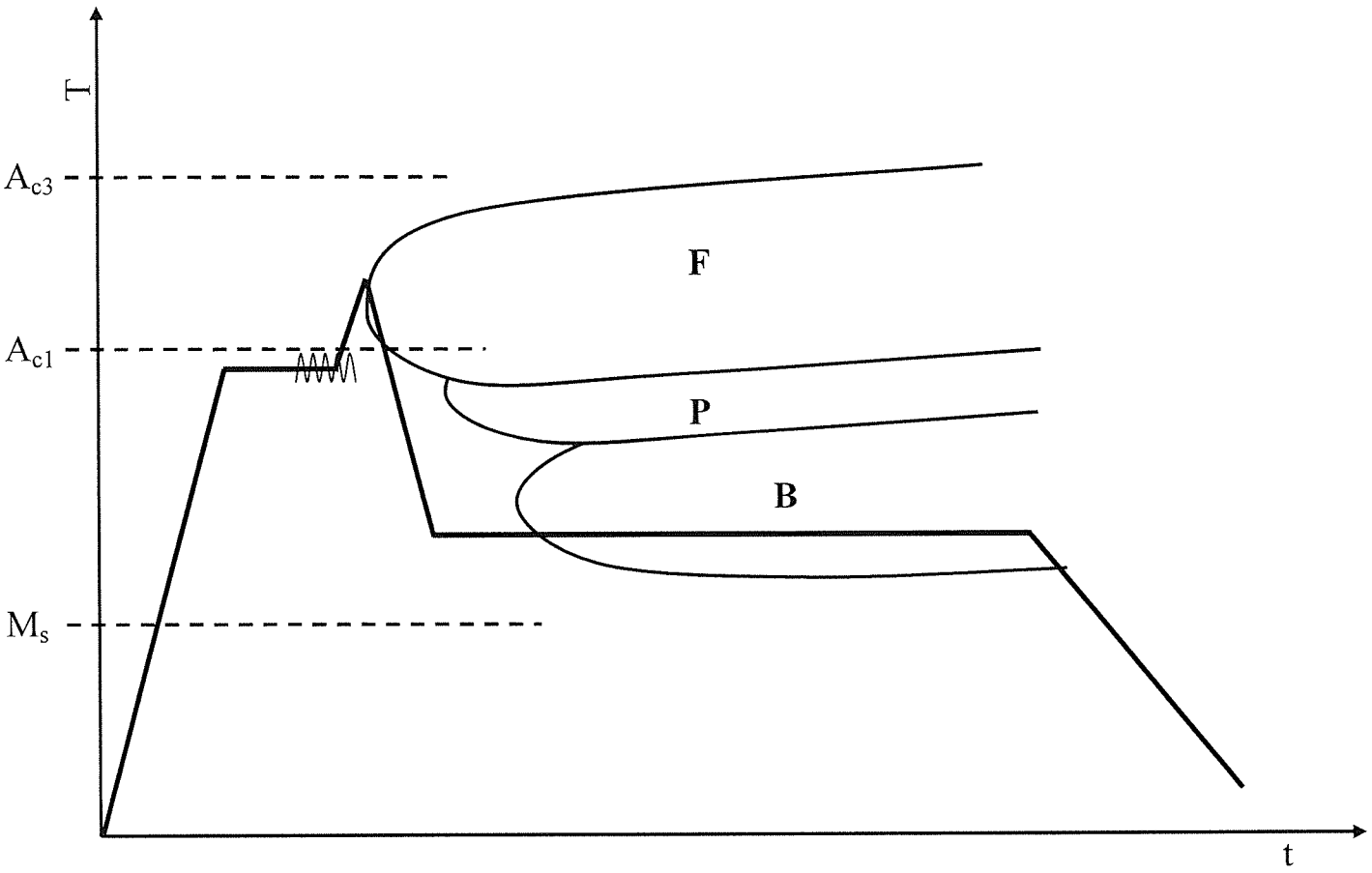

By way of example only, the feedstock material for the procedure for achieving the TRIP microstructure with the aid of deformation heat as illustrated in the isothermal transformation curve shown in FIG. 3 may be a high-strength low-alloyed TRIP steel containing 0.2 wt. % C, 1.4 wt. % Si, 1.8 wt. % Mn and a balance of Fe.

In a first step, the steel feedstock may be heated to a temperature below $Ac_1$, that is, below the austenite region of the steel in question, and held for 20 seconds. In this example, the heating temperature is 720° C.

In a next step, the feedstock is formed into the final product, using severe plastic deformation, the application of plastic deformation being illustrated by the wavy line just below $A_{C1}$ on the isothermal transformation curve for the steel shown in FIG. 3. Well known examples of applied forces for causing plastic deformation include the application of tensile (pulling) forces, compressive (pushing) forces, shear, bending or torque (twisting) forces. In the example illustrated by FIG. 3, forming (and thus plastic deformation) takes place by cross rolling over the feedstock for about 20 seconds using an incremental deformation schedule (i.e., application of cross rolling in a plurality or multiplicity of application steps), although as noted herein, plastic deformation can be caused in a single rolling instance or other force application (e.g. striking, twisting, pulling) processes.

Deformation energy introduced into the material during forming with severe plastic deformation raises its temperature to the final temperature in the range between $Ac_1$ and $A_{C3}$, i.e. between the lower and upper boundaries of its austenite region. In this example, the final temperature is about 770° C. and thus the severe plastic deformation is sufficient to increase the temperature of the material by about 50° C. above the final temperature. By this means, the ferrite-pearlite microstructure partially transforms into austenite.

In the last process step, the final product is cooled down from the final temperature to the temperature of the bainite nose B in the transformation diagram shown in FIG. 3, which in this example is about 425° C. In this example, the cooling curve intersects the ferrite region F but bypasses the pearlite region P. Cooling is interrupted for about 600 seconds at the temperature of the bainite nose B. Consequently, the material develops the microstructure typical of TRIP steels.

Finally, the product is cooled down to ambient temperature.

The example embodiment is shown in FIG. 3.

LIST OF REFERENCE SYMBOLS $M_S$—temperature, at which martensite begins to form
$Ac_1$—temperature, at which austenite begins to form
$Ac_3$—temperature, at which austenitization is completed
F—ferrite region
P—pearlite region
B—bainite region

The invention claimed is:

1. A method of achieving TRIP microstructure in steels by means of deformation heat comprising the steps of:

heating steel feedstock to a temperature below the temperature at which transformation to austenite begins, the feedstock having a ferrite-pearlite microstructure;

thereafter, forming the feedstock into a final product using severe plastic deformation, where the plastic deformation applies deformation energy to the feedstock which increases the feedstock's temperature to the final temperature between the temperature at which transformation to austenite begins and the temperature at which transformation to austenite is completed and whereupon a part of the ferrite-pearlite microstructure of the feedstock transforms into austenite;

cooling the final product from the final temperature to a temperature within the bainite nose and held, which causes TRIP microstructure to form;

cooling the final product down from the temperature within the bainite nose to ambient temperature.

2. A method of achieving TRIP microstructure in steels by means of deformation heat according to claim 1 wherein the feedstock material comprises a low-alloyed steel including at least one alloying component selected from the group consisting of Si, Mn and Al.

3. A method of achieving TRIP microstructure in steels by means of deformation heat according to claim 1 wherein the plastic deformation is introduced through incremental deformation schedule, where the forming procedure comprises a plurality of deformation steps.

* * * * *